US010226872B2

(12) United States Patent
Wilson

(10) Patent No.: US 10,226,872 B2
(45) Date of Patent: Mar. 12, 2019

(54) ELECTRIC SHAVING ASSEMBLY

(71) Applicant: Barbara Wilson, Mt. Vernon, NY (US)

(72) Inventor: Barbara Wilson, Mt. Vernon, NY (US)

( * ) Notice: Subject to any disclaimer, the term of this patent is extended or adjusted under 35 U.S.C. 154(b) by 0 days.

(21) Appl. No.: 15/634,703

(22) Filed: Jun. 27, 2017

(65) Prior Publication Data

US 2018/0370051 A1 Dec. 27, 2018

(51) Int. Cl.
*B26B 19/38* (2006.01)
*B26B 19/04* (2006.01)

(52) U.S. Cl.
CPC ..... *B26B 19/3813* (2013.01); *B26B 19/046* (2013.01); *B26B 19/3873* (2013.01)

(58) Field of Classification Search
CPC ..... B26B 19/3813; B26B 19/046; B26B 19/3873; B26B 19/14; B26B 19/145
USPC ..... 30/43.5, 194, 195
See application file for complete search history.

(56) References Cited

U.S. PATENT DOCUMENTS

| | | | | |
|---|---|---|---|---|
| 4,146,960 | A * | 4/1979 | Flowers | B26B 19/22 30/195 |
| 4,977,672 | A | 12/1990 | Hamilton | |
| 6,378,210 | B1 * | 4/2002 | Bickford | B26B 19/3806 30/122 |
| 6,836,965 | B1 | 1/2005 | Ross | |
| 7,246,447 | B2 | 7/2007 | Demko | |
| D636,125 | S | 4/2011 | Schulz et al. | |
| 8,141,253 | B2 | 3/2012 | Royle | |
| 8,365,744 | B1 | 2/2013 | Branch | |
| 2006/0207104 | A1 * | 9/2006 | Alvite | A01K 13/002 30/216 |

FOREIGN PATENT DOCUMENTS

WO WO2006015703 2/2006

* cited by examiner

*Primary Examiner* — Phong Nguyen

(57) ABSTRACT

An electric shaving assembly for shaving decorative designs in hair includes a shaver. A cutting assembly is operationally coupled to the shaver and is configured to cut hair. Each of a plurality of masks is selectively couplable to the shaver to cover the cutting assembly. Each of a plurality of openings is positioned in a top of a respective mask. Each opening has a shape so that the plurality of openings has a variety of shapes, such as letters of the alphabet and designs. Each mask is configured to contact skin of a user to position the cutting assembly to shave a respective shape into the hair on the skin.

11 Claims, 4 Drawing Sheets

ELECTRIC SHAVING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shaving assemblies and more particularly pertains to a new shaving assembly for shaving decorative designs in hair.

BRIEF SUMMARY OF THE INVENTION

An embodiment of the disclosure meets the needs presented above by generally comprising a shaver. A cutting assembly is operationally coupled to the shaver and is configured to cut hair. Each of a plurality of masks is selectively couplable to the shaver to cover the cutting assembly. Each of a plurality of openings is positioned in a top of a respective mask. Each opening has a shape so that the plurality of openings has a variety of shapes, such as letters of the alphabet and designs. Each mask is configured to contact skin of a user to position the cutting assembly to shave a respective shape into the hair on the skin.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
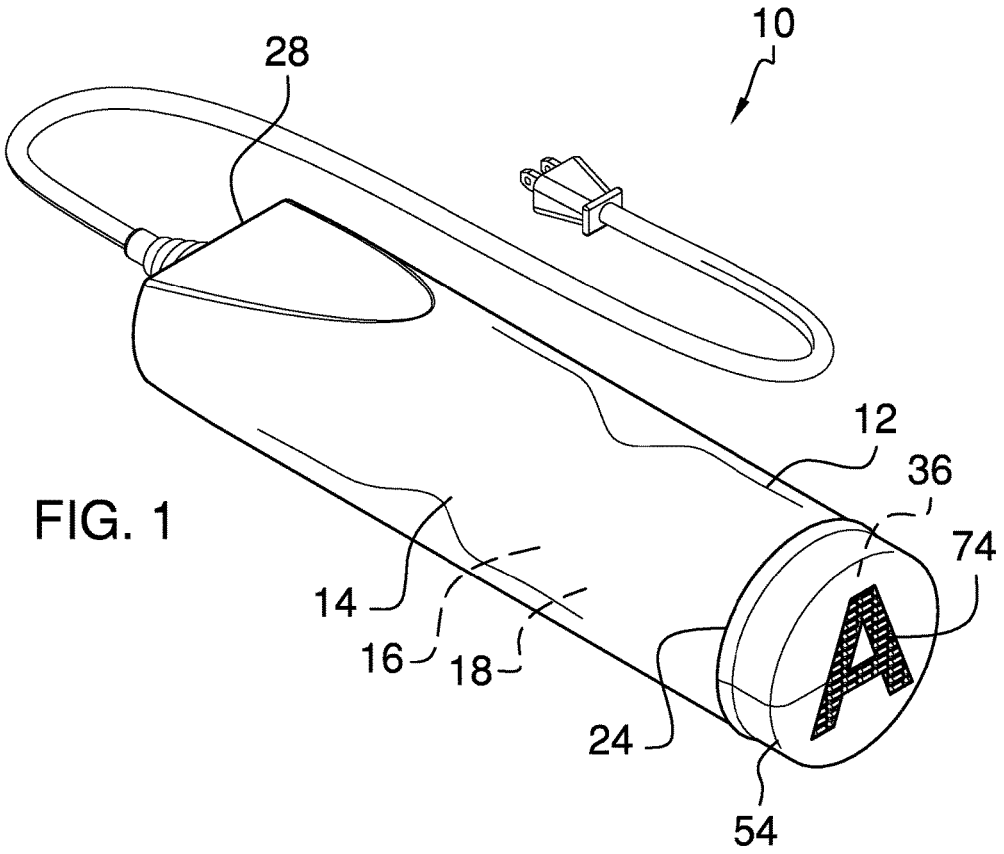
FIG. 1 is an isometric perspective view of an electric shaving assembly according to an embodiment of the disclosure.
Figure 2:
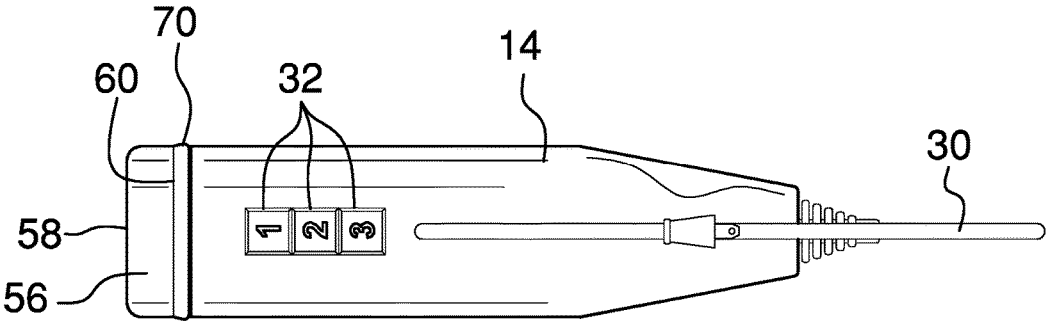
FIG. 2 is a top view of an embodiment of the disclosure.
Figure 3:
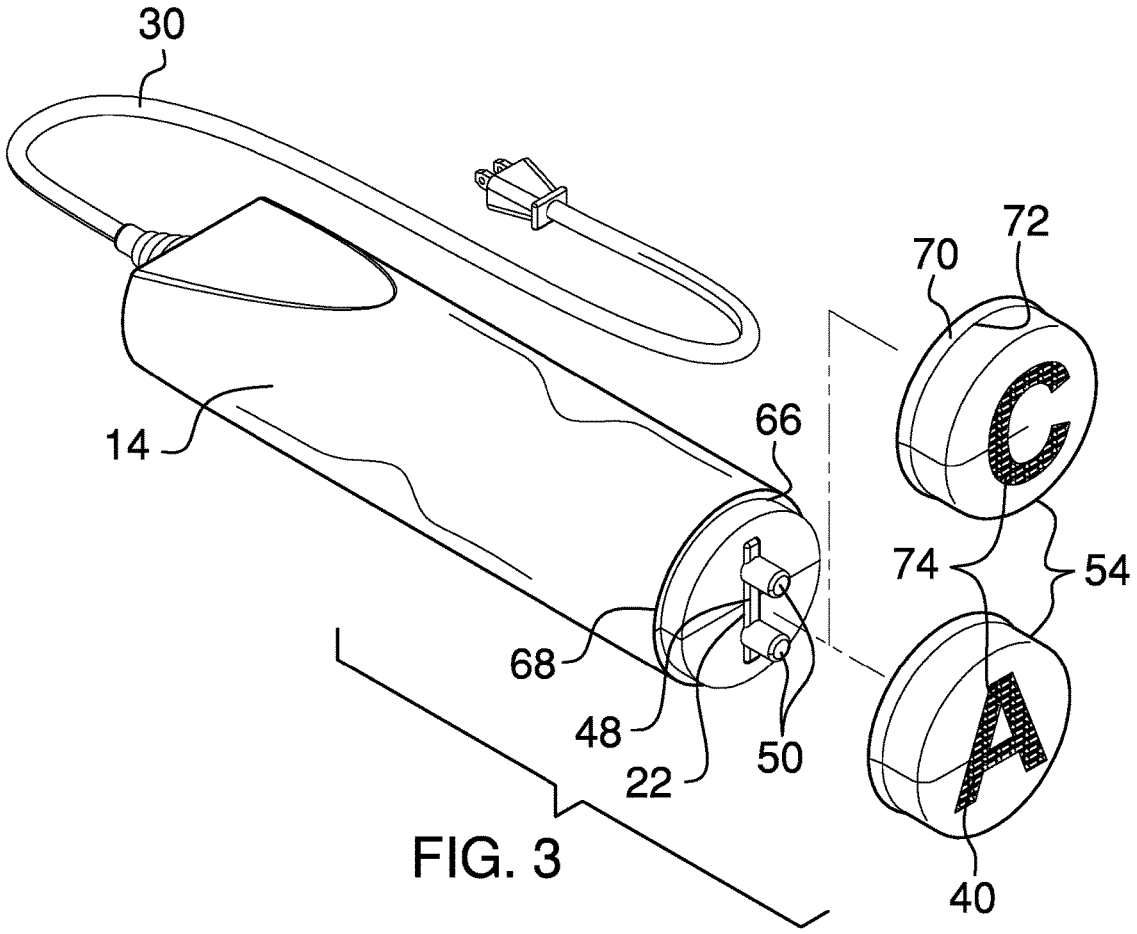
FIG. 3 is an exploded view of an embodiment of the disclosure.
Figure 4:
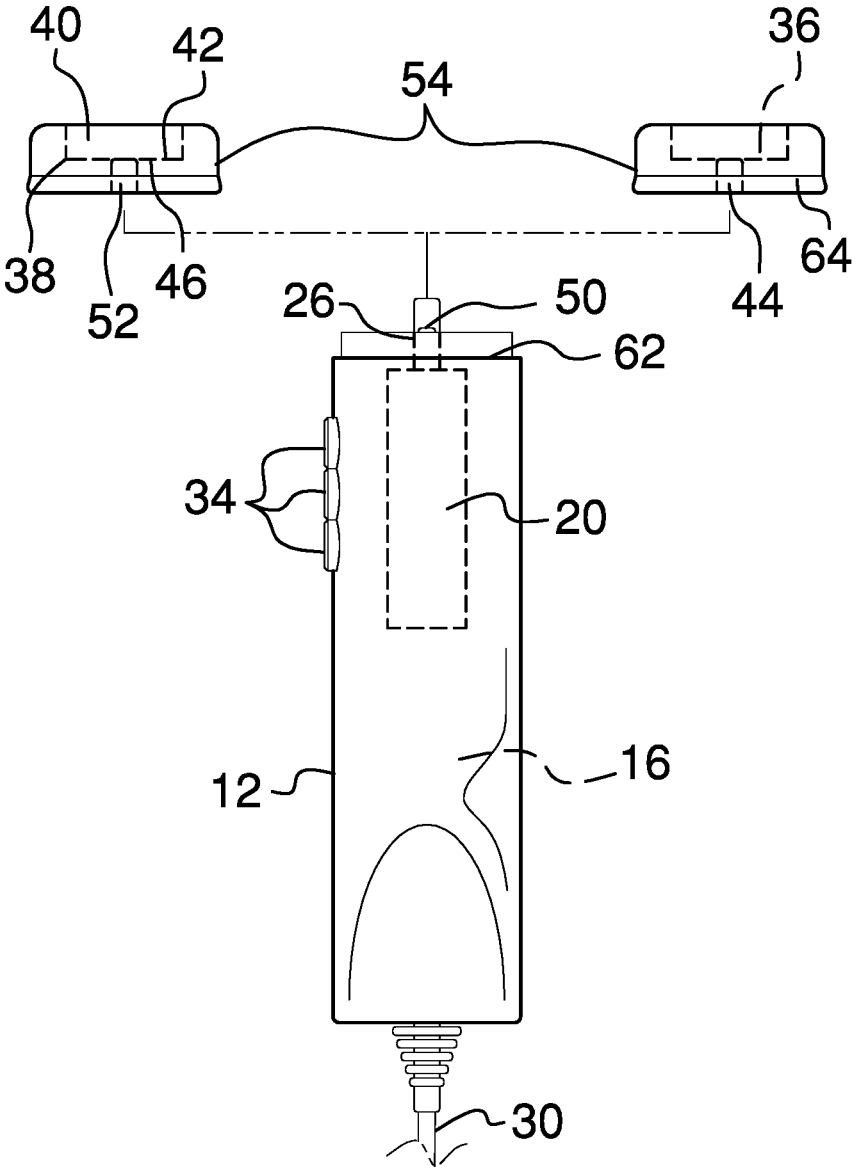
FIG. 4 is a side view of an embodiment of the disclosure.
Figure 5:
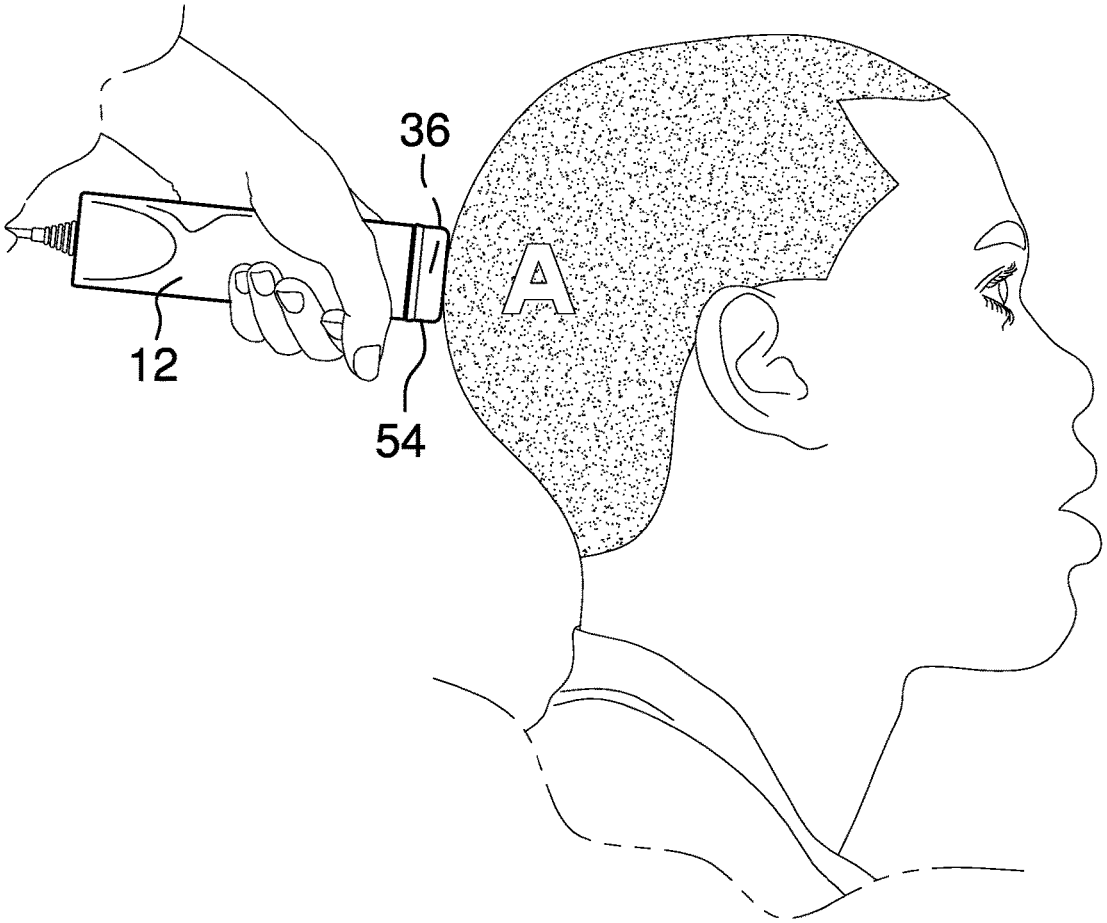
FIG. 5 is an in-use view of an embodiment of the disclosure.

With reference now to the drawings, and in particular to FIGS. 1 through 5 thereof, a new shaving assembly embodying the principles and concepts of an embodiment of the disclosure and generally designated by the reference numeral 10 will be described.

As best illustrated in FIGS. 1 through 5, the electric shaving assembly 10 generally comprises a shaver 12. The shaver 12 comprises a housing 14 that defines an internal space 16. A power module 18 and a motor 20 are coupled to the housing 14 and are positioned in the internal space 16. The motor 20 is operationally coupled to the power module 18. A penetration 22 is positioned in a second end 24 of the housing 14. A first coupler 26 is operationally coupled to the motor 20. The first coupler 26 extends from the motor 20 through the penetration 22.

In one embodiment, the housing 14 is substantially cylindrically shaped. The housing 14 has a first end 28. In another embodiment, the first end 28 is tapered. In yet another embodiment, the power module 18 comprises a power cord 30 that extends from the first end 28 of the housing 14. The power cord 30 is configured to couple to a source of alternating current. In still yet another embodiment, the penetration 22 is rectangularly shaped.

A controller 32 is coupled to the housing 14. The controller 32 is operationally coupled to the power module 18 and the motor 20. The controller 32 is positioned to selectively couple the power module 18 to the motor 20. In one embodiment, the controller 32 comprises a plurality of buttons 34. The buttons 34 are selectively depressible. Each button 34 is configured to be selectively depressed to select a respective speed of the motor 20. In another embodiment, the plurality of buttons 34 comprises three buttons 34 that correspond to a high speed, a medium speed, and a low speed of the motor 20.

A cutting assembly 36 is operationally coupled to the shaver 12. The cutting assembly 36 is configured to cut hair. In one embodiment, the cutting assembly 36 comprises a disc 38. A plurality of blades 40 is coupled to and extends from a front face 42 of the disc 38. A second coupler 44 is coupled to a back face 46 of the disc 38. The second coupler 44 is complementary to the first coupler 26. The second coupler 44 is positioned to couple to the first coupler 26 to couple the cutting assembly 36 to the shaver 12.

In another embodiment, the first coupler 26 comprises a bar 48 and a pair of rods 50. The bar 48 is substantially complementary to and is positioned in the penetration 22.

The bar 48 is operationally coupled to the motor 20. The rods 50 are coupled to and extend from the bar 48 so that the rods 50 protrude from the second end 24 of the housing 14. The motor 20 is positioned to oscillate the bar 48 and the rods 50. In this embodiment, the second coupler 44 comprises a pair of tubes 52. Each tube 52 is positioned to insert a respective rod 50 to couple the cutting assembly 36 to the shaver 12 so that the cutting assembly 36 is configured to cut hair.

Each of a plurality of masks 54 is selectively couplable to the shaver 12 to cover the cutting assembly 36. Each mask 54 comprises an annular wall 56 that extends between a top 58 and a bottom 60. The bottom 60 is open. In one embodiment, the top 58 and the bottom 60 are circularly shaped. In another embodiment, each mask 54 comprises a respective cutting assembly 36 such that the respective cutting assembly 36 is integral to the mask 54.

A first fastener 62 is coupled to the housing 14. Each of a plurality of second fasteners 64 is coupled to a respective mask 54. The second fasteners 64 are complementary to the first fastener 62*s*. Each second fastener 64 is positioned to couple to the first fastener 62 to couple the respective mask 54 to the shaver 12. In one embodiment, the first fastener 62 comprises a recess 66 that is positioned around a perimeter 68 of the second end 24 of the housing 14. In this embodiment, each second fastener 64 comprises a lip 70 that is coupled to and extends radially from a circumference 72 of the bottom 60 of the respective mask 54. The lip 70 is complementary to the recess 66. The lip 70 is positioned to insert the second end 24 of the shaver 12 to couple the respective mask 54 to the shaver 12.

Each of a plurality of openings 74 is positioned in the top 58 of a respective mask 54. Each opening 74 has a shape so that the plurality of openings 74 has a variety of shapes, such as letters of the alphabet and designs. Each mask 54 is configured to contact skin of a user to position the cutting assembly 36 to shave a respective shape into the hair on the skin.

In use, each tube 52 is positioned to insert a respective rod 50 to couple the cutting assembly 36 to the shaver 12. The lip 70 is positioned to insert the second end 24 of the shaver 12 to couple the respective mask 54 to the shaver 12. The motor 20 is positioned to oscillate the bar 48 and the rods 50 so that the plurality of blades 40 is motivated across the respective opening. Each mask 54 is configured to contact the skin of the user to position the cutting assembly 36 to shave the respective shape, such as the letters of the alphabet and the design, into the hair on the skin.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electric shaving assembly comprising:

a shaver, said shaver comprising a housing defining an internal space, a power module coupled to said housing and positioned in said internal space, a motor coupled to said housing and positioned in said internal space, said motor being operationally coupled to said power module, a penetration positioned in a second end of said housing, a first coupler operationally coupled to said motor, said first coupler extending from said motor through said penetration, said first coupler comprising a bar and a pair of rods, said bar being substantially complementary to and positioned in said penetration, said bar being operationally coupled to said motor, said rods being coupled to and extending from said bar such that said rods protrude from said second end of said housing, a controller coupled to said housing, said controller being operationally coupled to said power module and said motor, and wherein said controller is positioned on said housing such that said controller is positioned for selectively coupling said power module to said motor;

a cutting assembly operationally coupled to said shaver, said cutting assembly comprising a disc, a plurality of blades coupled to and extending from a front face of said disc, a second coupler coupled to a back face of said disc, said second coupler being complementary to said first coupler, said second coupler comprising a pair of tubes, wherein said tubes are positioned on said disc such that each said tube is positioned for inserting a respective said rod for coupling said cutting assembly to said shaver, wherein said bar is positioned on said motor such that said motor is positioned for oscillating said bar and said rods such that said cutting assembly is configured for cutting hair, and wherein said second coupler is positioned on said disc such that said second coupler is positioned for coupling to said first coupler for coupling said cutting assembly to said shaver, wherein said plurality of blades is positioned on said disc such that said motor is positioned for oscillating said bar and said rods such that said plurality of blades is motivated across the respective opening;

a plurality of masks, said masks being selectively couplable to said shaver for covering said cutting assembly;

a plurality of openings, each said opening being positioned in a top of a respective said mask, each said opening having a shape such that said plurality of openings has a variety of shapes; and wherein said cutting assembly is positioned on said shaver such that said cutting assembly is configured for cutting hair, wherein said openings are positioned in said masks such that each said mask is configured for contacting skin of a user positioning said cutting assembly for shaving a respective shape into the hair on the skin.

2. The assembly of claim 1, further including said housing being substantially cylindrically shaped, said housing having a first end, said first end being tapered.

3. The assembly of claim 1, further including said power module comprising a power cord extending from a first end of said housing, said power cord being configured for coupling to a source of alternating current.

4. The assembly of claim 1, further including said penetration being rectangularly shaped.

5. The assembly of claim 1, further including said controller comprising a plurality of buttons, said buttons being selectively depressible, each said button being configured for selectively depressing for selecting a respective speed of said motor.

6. The assembly of claim 5, further including said plurality of buttons comprising three said buttons corresponding to a high speed, a medium speed, and a low speed of said motor.

7. The assembly of claim 1, further including each said mask comprising a respective said cutting assembly such that said respective said cutting assembly is integral to said mask.

8. The assembly of claim 1, further including each said mask comprising an annular wall extending between a top and a bottom, said bottom being open, said top and said bottom being circularly shaped.

9. The assembly of claim 8, further comprising:

a first fastener coupled to said housing;

a plurality of second fasteners, each said second fastener being coupled to a respective said mask, said second fasteners being complementary to said first fasteners; and wherein said second fasteners are positioned on said masks such that each said second fastener is positioned for coupling to said first fastener for coupling said respective said mask to said shaver.

10. The assembly of claim 9, further comprising:

said first fastener comprising a recess positioned around a perimeter of said second end of said housing;

each said second fastener comprising a lip coupled to and extending radially from a circumference of said bottom of said respective said mask, said lip being complementary to said recess; and wherein said lip is positioned on said bottom such that said lip is positioned for inserting said second end of said shaver for coupling said respective said mask to said shaver.

11. An electric shaving assembly comprising:

a shaver, said shaver comprising:

a housing defining an internal space, said housing being substantially cylindrically shaped, said housing having a first end, said first end being tapered, a power module coupled to said housing and positioned in said internal space, said power module comprising a power cord extending from said first end of said housing, said power cord being configured for coupling to a source of alternating current, a motor coupled to said housing and positioned in said internal space, said motor being operationally coupled to said power module, a penetration positioned in a second end of said housing, said penetration being rectangularly shaped, a first coupler operationally coupled to said motor, said first coupler extending from said motor through said penetration, said first coupler comprising a bar and a pair of rods, said bar being substantially complementary to and positioned in said penetration, said bar being operationally coupled to said motor, said rods being coupled to and extending from said bar such that said rods protrude from said second end of said housing, wherein said bar is positioned on said motor such that said motor is positioned for oscillating said bar and said rods, a controller coupled to said housing, said controller being operationally coupled to said power module and said motor, wherein said controller is positioned on said housing such that said controller is positioned for selectively coupling said power module to said motor, said controller comprising a plurality of buttons, said buttons being selectively depressible, each said button being configured for selectively depressing for selecting a respective speed of said motor, said plurality of buttons comprising three said buttons corresponding to a high speed, a medium speed, and a low speed of said motor, and a first fastener coupled to said housing, said first fastener comprising a recess positioned around a perimeter of said second end of said housing;

a cutting assembly operationally coupled to said shaver, wherein said cutting assembly is positioned on said shaver such that said cutting assembly is configured for cutting hair, said cutting assembly comprising:

a disc, a plurality of blades coupled to and extending from a front face of said disc, wherein said plurality of blades is positioned on said disc such that said motor is positioned for oscillating said bar and said rods such that said plurality of blades is motivated across the respective opening, and a second coupler coupled to a back face of said disc, said second coupler being complementary to said first coupler, wherein said second coupler is positioned on said disc such that said second coupler is positioned for coupling to said first coupler for coupling said cutting assembly to said shaver, said second coupler comprising a pair of tubes, wherein said tubes are positioned on said disc such that each said tube is positioned for inserting a respective said rod for coupling said cutting assembly to said shaver such that said cutting assembly is configured for cutting hair;

a plurality of masks, said masks being selectively couplable to said shaver for covering said cutting assembly, each said mask comprising a respective said cutting assembly such that said respective said cutting assembly is integral to said mask, each said mask comprising an annular wall extending between a top and a bottom, said bottom being open, said top and said bottom being circularly shaped;

a plurality of second fasteners, each said second fastener being coupled to a respective said mask, said second fasteners being complementary to said first fasteners, wherein said second fasteners are positioned on said masks such that each said second fastener is positioned for coupling to said first fastener for coupling said respective said mask to said shaver, each said second fastener comprising a lip coupled to and extending radially from a circumference of said bottom of said respective said mask, said lip being complementary to said recess, wherein said lip is positioned on said bottom such that said lip is positioned for inserting said second end of said shaver for coupling said respective said mask to said shaver;

a plurality of openings, each said opening being positioned in said top of a respective said mask, each said opening having a shape such that said plurality of openings has a variety of shapes, wherein said openings are positioned in said masks such that each said mask is configured for contacting skin of a user positioning said cutting assembly for shaving a respective shape into the hair on the skin; and wherein said tubes are positioned on said disc such that each said tube is positioned for inserting said respective said rod for coupling said cutting assembly to said shaver such that said cutting assembly is configured for cutting the hair, wherein said lip is positioned on said bottom such that said lip is positioned for inserting said second end of said shaver for coupling said respective said mask to said shaver, wherein said bar is positioned on said motor such that said motor is positioned for oscillating said bar and said rods such that said plurality of blades is motivated across the respective opening, wherein said openings are positioned in said masks such that each said mask is configured for contacting the skin of the user positioning said cutting assembly for shaving the respective shape into the hair on the skin.

* * * * *